US006855879B2

(12) United States Patent
Minakuchi et al.

(10) Patent No.: US 6,855,879 B2
(45) Date of Patent: Feb. 15, 2005

(54) ELECTRIC STRINGED MUSICAL INSTRUMENT HAVING FASTENER SHARED BETWEEN FRAME BODY AND STRAP

(75) Inventors: Kiyoshi Minakuchi, Shizuoka (JP); Akio Naniki, Shizuoka (JP); Katsuya Suzuki, Shizuoka (JP)

(73) Assignee: Yamaha Corporation, Shizuoka-ken (JP)

( * ) Notice: Subject to any disclaimer, the term of this patent is extended or adjusted under 35 U.S.C. 154(b) by 66 days.

(21) Appl. No.: 10/292,767

(22) Filed: Nov. 13, 2002

(65) Prior Publication Data

US 2003/0106411 A1 Jun. 12, 2003

(30) Foreign Application Priority Data

Nov. 19, 2001 (JP) ..... 2001-352955

(51) Int. Cl.[7] ..... G10D 3/00

(52) U.S. Cl. ..... 84/327; 84/421; 84/291; 84/267

(58) Field of Search ..... 84/327, 421, 291, 84/267

(56) References Cited

U.S. PATENT DOCUMENTS

| | | | | |
|---|---|---|---|---|
| 3,302,507 A | | 2/1967 | Fender | |
| 3,910,151 A | | 10/1975 | Copeland | |
| 4,144,794 A | * | 3/1979 | Silverman et al. | 84/327 |
| 4,274,181 A | * | 6/1981 | Schaller | 24/656 |
| 4,291,822 A | * | 9/1981 | Simonds | 224/257 |
| 4,632,002 A | * | 12/1986 | Clevinger | 84/731 |
| 5,076,131 A | * | 12/1991 | Patterson | 84/421 |
| 6,664,461 B2 | * | 12/2003 | Tamura | 84/743 |

FOREIGN PATENT DOCUMENTS

| | | |
|---|---|---|
| DE | 82 32 675 U | 5/1983 |
| DE | 195 40 668 A1 | 5/1997 |
| JP | 61-46559 | 12/1986 |
| JP | 62-26797 | 7/1987 |
| JP | 62-33598 | 7/1987 |

OTHER PUBLICATIONS

Brief comments detailing references JP 62–33598, JP 62–26797, DE 195 40 668 A1, JP 61–46559 and Trademark Reg. No. 2,401,468.
Trademark Reg. No. 2,401,468.
Copy of German Office Action dated Jan. 20, 2004 (and English translation of relevant portion).

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

An electric stringed instrument has a frame body the contour of which is like the outline of a solid body of a corresponding electric or acoustic stringed instrument; the frame body is constituted by plural frame pieces, and the frame piece is detachably connected to a trunk of the electric stringed instrument; a user slings the electric stringed instrument over his or her shoulder by means of a strap so that the strap is to be connected to the trunk by means of fasteners; the fasteners are further used for securing the frame piece to the trunk so that the frame pieces are not unintentionally dropped out from the trunk without increasing the fasteners.

15 Claims, 4 Drawing Sheets

ELECTRIC STRINGED MUSICAL INSTRUMENT HAVING FASTENER SHARED BETWEEN FRAME BODY AND STRAP

FIELD OF THE INVENTION

This invention relates to an electric stringed musical instrument and, more particularly, to an electric stringed musical instrument having a frame separable from a trunk over which strings are stretched.

DESCRIPTION OF THE RELATED ART

Electric guitars belong to the electric stringed musical instrument. Players usually sling the electric guitars over their shoulders with straps, and pluck the strings so as to give rise to vibrations of the strings. The vibrations of the strings are converted to electric signals by means of pickup units, and the electric tones are radiated from the associated sound systems.

Various sorts of electric guitars have been sold in the market. Electric guitars with solid bodies have been popular to the guitarists. The electric guitar has a solid body, and a neck projects from the solid body. Strings are stretched over the neck, and a pickup unit is provided under the strings. The solid body is made from a wood panel or of synthetic resin, and silver fir or spruce is preferable for the solid body. Although several sorts of solid bodies are formed with hollow spaces, the hollow spaces are not expected to serve as resonators, because the amplifiers increase the loudness of the electric tones.

Nevertheless, some electric guitars have bodies formed with resonators, and are called as "electric acoustic guitar". In this instance, the non-solid body is assembled from deck boards and a sideboard. The deck boards and sideboard define the resonator, and a center block of maple reinforces the non-slid body.

The electric guitars are equipped with electromagnetic pickup units, and the electromagnetic pickup units convert the vibrations of steel strings to the electric signals. Pressure-sensitive pickup units may be employed for other electric guitars. In this instance, nylon strings or gut strings may extend over the pressure-sensitive pickup units.

Those bodies, pickup units and strings form a wide variety of electric guitars. As described hereinbefore, the resonators are not required for the electric guitars with the exception of the electric acoustic guitars. Frame bodies have been proposed for the electric guitars. The frame bodies are so light that guitarists feel the electric guitars easy to keep them around the waists.

FIG. 1 shows a typical example of the frame body 1 forming a part of the electric guitar 2. The electric guitar 2 further comprises a trunk 3 and strings 4. The trunk 3 serves as a boss 3*a* and a neck 3*b*. The frame 1 sideward expands from the boss 3*a*, and frets 5 are embedded in the neck 3*b* at intervals. The strings 4 are made of nylon. The strings 4 are stretched over the frets 5 and a bridge 6*a*, and are terminated at a tailpiece 6*b* and pegs (not shown). The boss 3*a* is formed with a peg box 3*c*, and pegs 7 are rotatably supported by the peg box 3*c*. The strings 4 are anchored to the pegs 7, respectively, and the user gives the tension to the strings 4 by winding the strings 4 around the pegs 7.

Three frame pieces 1*a*, 1*b* and 1*c* form in combination the frame body 1, and make users to image the outline of the conventional guitar body. The frame pieces 1*a* and 1*b* are attached to the left side of the trunk 3, and the other frame piece 1*c* is attached to the right side of the trunk 3. A strap S is connected to the trunk 3 by means of couplers C, and the user slings the electric guitar 2 over the shoulder by using the strap S. The strap is connected to the trunk 3 by means of couplers.

Plugs 8 are fixed to both ends of each frame piece 3*a*/32*b*/3*c*, and sleeves 9 are embedded in the trunk 3 as shown in FIG. 2. The sleeves 9 are open to the outside on the side surfaces of the trunk 3. When the user assembles the frame pieces 1*a*/1*b*/1*c* with the trunk 3, he or she pushes the plugs 8 into the sleeves 9. Friction takes place between the outer surfaces of the plugs 8 and the inner surfaces of the sleeves 9, and keeps the plugs 8 in the sleeves 9. On the other hand, when the user disassembles the frame body 1 from the trunk 3, he or she pulls out the plugs 8. Thus, the electric guitar 2 is separable into frame pieces 1*a*/1*b*/1*c* and trunk 3.

The detachable frame body 3 is desirable for the users, because the parts 1*a*/1*b*/1*c*/3 are received in a small case. However, a problem is encountered in the prior art electric guitar 2 in that the frame pieces 1*a*/1*b*/1*c* tend to be dropped out from the trunk 3 in the performance. When the user wants to get ready to play the electric guitar 2, he or she assembles the frame pieces 1*a*/1*b*/1*c* with the trunk 3. When the user finishes the practice, he or she disassemble the frame pieces 1*a*/1*b*/1*c* from the trunk 3, and puts the parts 1*a*/1*b*/1*c*/3 in the case. The plugs 8 are pushed into the sleeves 9 and pulled out at every practice and performance. The plugs 8 and sleeves 9 are worn out, and, accordingly, the friction is reduced. As a result, the frame pieces 1*a*/1*b*/1*c* are liable to be dropped out from the trunk 3 in the practice or performance.

SUMMARY OF THE INVENTION

It is therefore an important object of the present invention to provide an electric stringed instrument which is simple in outer appearance and not unintentionally separated into parts.

The inventors contemplated the problem inherent in the electric stringed instrument of the type having the frame body, i.e., the electric guitar. The inventors firstly pressed the plugs 8 to the trunk 3 by means of bolts. The trunk 3 was jammed with the frame pieces 1*a*/1*b*/1*c*, couplers C and bolts. The frame pieces 1*a*/1*b*/1*c* were implanted into the trunk 3 at the six points on the trunk 3, the plugs were pressed to the trunk 3 with the bolts, and the strap S were anchored at both ends to the trunk 3 by means of the couplers C. The frame pieces 1*a*/1*b*/1*c*, bolts and couplers C occupied the respective areas on the trunk 3, and the users felt the electric guitar disgraceful.

To accomplish the object, the present invention proposes to share fasteners between a frame body and a strap.

In accordance with one aspect of the present invention, there is provided a stringed musical instrument slung over a shoulder of a player for playing a piece of music comprising a trunk having plural surfaces, at least one string stretched over one of the plural surfaces between both end portions of the trunk, a frame body having end portions inserted into recesses formed in the trunk and open to the outside on selected ones of the plural surfaces, a strap making the player sling the stringed musical instrument over the shoulder, and fasteners shared between the frame body and the strap for securing the end portions and both end portions of the strap to the trunk.

BRIEF DESCRIPTION OF THE DRAWINGS

The features and advantages of the electric stringed instrument will be more clearly understood from the following description taken in conjunction with the accompanying drawings, in which.

DESCRIPTION OF THE PREFERRED EMBODIMENTS

First Embodiment

Figure 1:
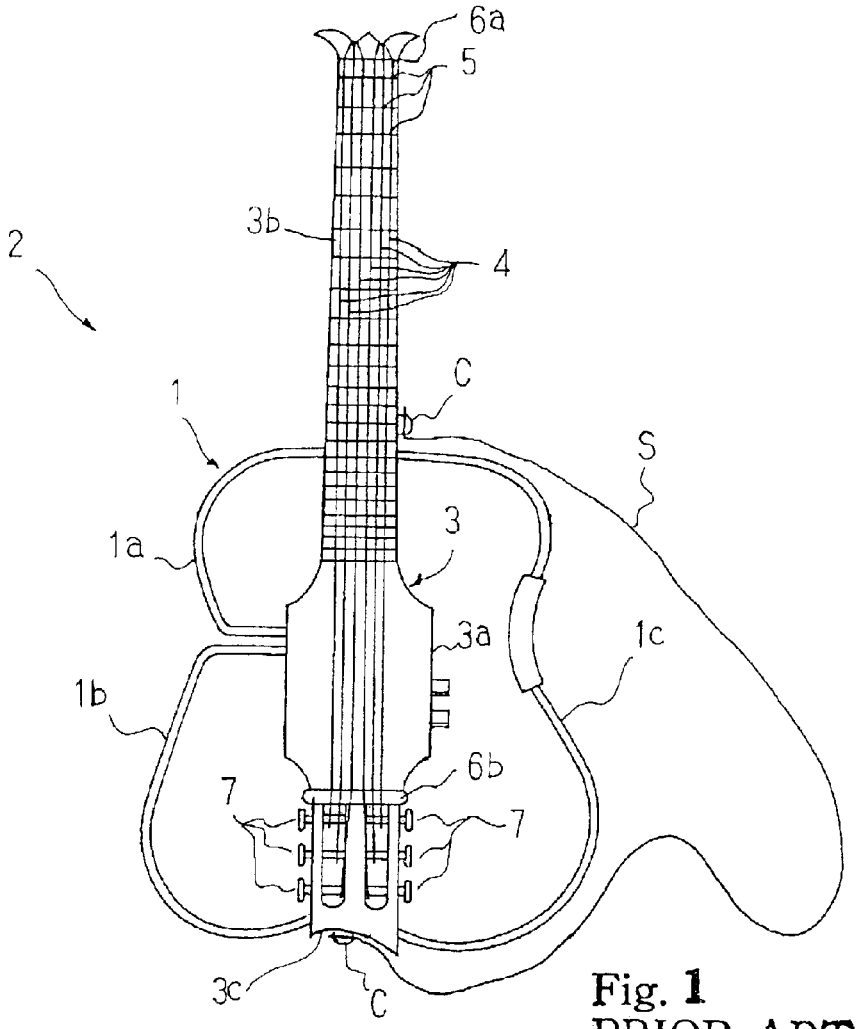
Fig. 1 PRIOR ART
FIG. 1 is a front view showing the structure of the prior art electric guitar.
Figure 2:
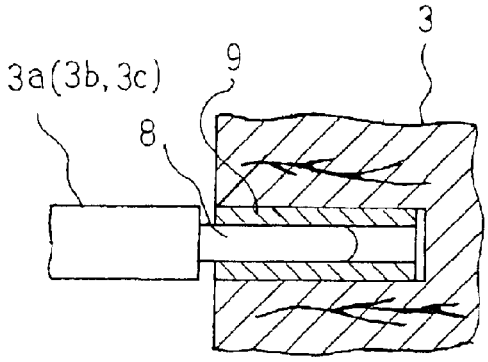
Fig. 2 PRIOR ART
FIG. 2 is a cross sectional view showing the plug and sleeve used for connecting the frame pieces to the trunk.
Figure 3:
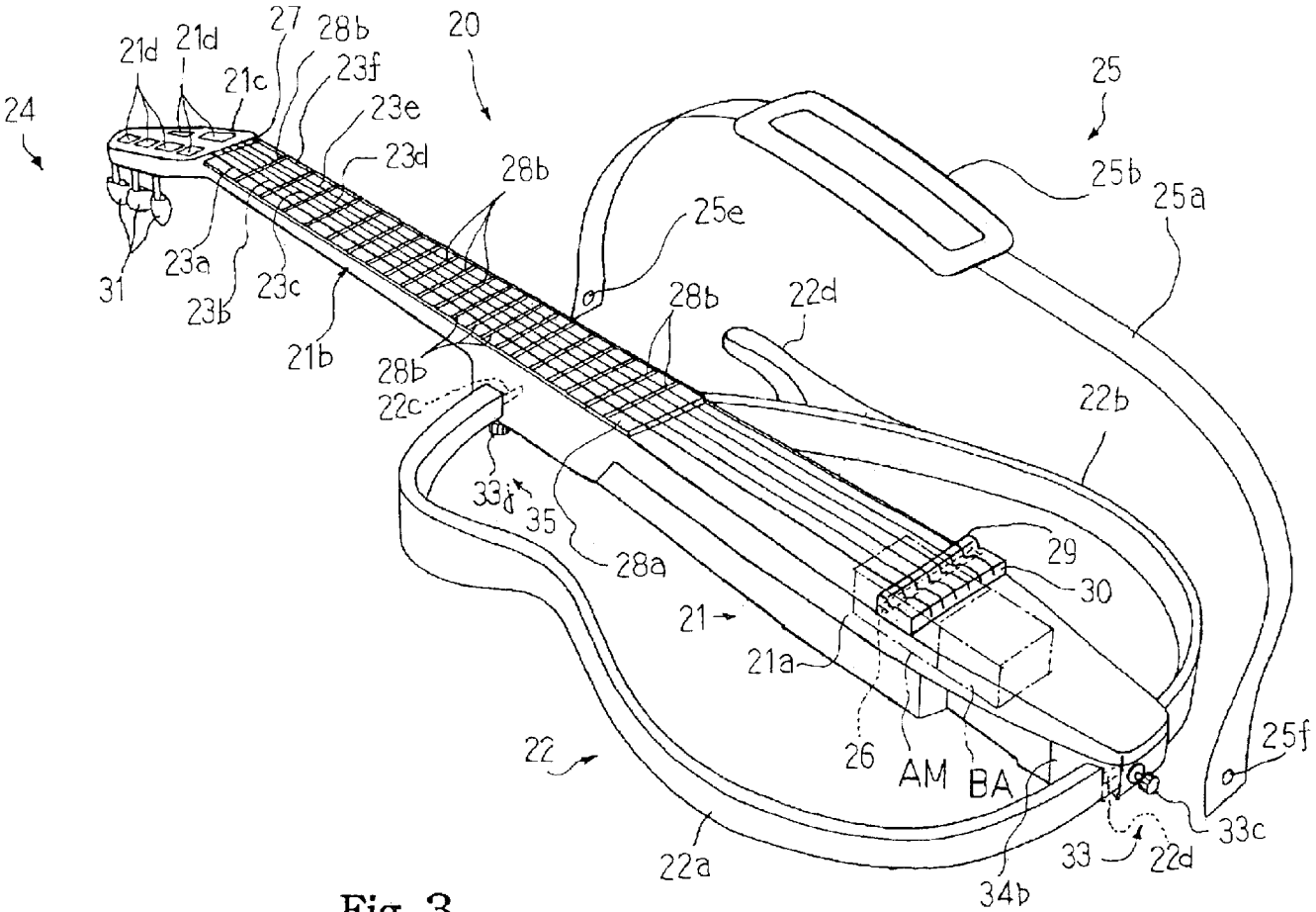
FIG. 3 is a perspective view showing an electric guitar according to the present invention.

Referring to FIG. 3 of the drawings, an electric guitar 20 embodying the present invention largely comprises a trunk 21, a frame body 22, six strings 23*a*, 23*b*, 23*c*, 23*d*, 23*e* and 23*f*, an anchor 24, a strap 25 and a pickup 26. The trunk 21 is made of wood, and is partially thick and wide and partially thin and narrow. The thick wide portion is referred to as "boss", and the boss is labeled with reference "21*a*". On the other hand, the thin narrow portion is referred to as "neck", and the neck is labeled with reference "21*b*".

The neck 21*b* has an upper surface substantially coplanar with the upper surface of the boss 21*a*, and a leading end portion 21*c* of the neck 21*b* is downwardly bent from the remaining portion of the neck 21*b*. Six holes 21*d* are formed in the leading end portion 21*c*, and a fingerboard 28*a* is adhered to the upper surface of the remaining portion of the neck 21*b*. A bridge 27 is embedded in the neck 21*b* at the boundary between the leading end portion 21*c* and the remaining portion, and frets 28*b* are embedded in the finger board 28*a* at intervals. The frets 28*b* extend in the lateral direction of the fingerboard 28*a*, and are spaced from one another in the longitudinal direction of the fingerboard 28*a*.

A bridge 29 is embedded in a tailpiece 30, and is exposed to the upper surface of the tailpiece 30. The tailpiece 30 is fixed to the upper surface of the boss 21*a*. The pickup 26 is further embedded in the tailpiece 30, and vibrations of the bridge 29 are propagated to the pickup 26. The pickup 26 may be same as the pickups disclosed in Japan Patent Publication No. sho-62-33598 or any one of the pickups disclosed in Japan Utility Model Registration Nos. sho-61-46559 and sho-62-26797.

A hollow space is formed in the boss 21*a*, and a battery BA and pre-amplifier AM are received in the hollow space. The pre-amplifier AM is connected to the pickup 26, and is powered with the battery BA. The user manipulates switches (not shown) provided on the outer surface of the boss 21*a* for a tone control. The pre-amplifier AM is responsive to the instructions given through the switches for controlling the electric tone, balance and volume. The pre-amplifier AM is connected to a signal port (not shown), and the electric signal is output from the pre-amplifier AM through the signal port to a main amplifier (not shown).

The strings 23*a* to 23*f* are anchored to the tailpiece 30, and extend over the upper surface of the boss 21*a* and the fingerboard 28*a*. Six pegs 31 are provided at the leading end portion 21*c*, and are engaged with shafts (not shown) rotatable in the holes 21*d*. The strings 23*a* to 23*f* are connected at the other ends thereof to the shafts. The shafts are driven for rotation by means of the pegs 31 so that a user exerts tension on and removes the tension from the strings 23*a* to 23*f* by turning the pegs 31. When the user exerts the tension on the strings 23*a* to 23*f*, the strings 23*a* to 23*f* are pressed to the bridges 27 and 29 at both end portions thereof. However, the strings 23*a* to 23*f* float over the frets 28*b* between the bridges 27 and 29. Thus, the tailpiece 30, shafts and pegs 31 serve as the anchor 24.

The frame body 22 is made of metal, alloy, synthetic resin or wood, and is shaped like the outline of the rigid body of the prior art electric guitar. In this instance, the frame body 22 is separated into two frame pieces 22*a* and 22*b*. Although the frame piece 22*b* is fixed to the boss 21*a*, the frame piece 22*a* is detachably connected to the boss 21*a*.

The frame piece 22*a* is constricted at the intermediate portion, and plugs 22*c* project from both ends of the frame piece 22*a*. On the other hand, the frame piece 22*b* is gently curved, and a grip 22*d* projects from the frame piece 22*b*. The frame piece 22*b* is fixed to the side surface of the boss 21*a* close to the string 23*f*, and, accordingly, is not detachable. Holes are formed in the boss 21*a*, and are open to the outside on the other side surface close to the string 23*a*. The plugs 22*c* are inserted into the holes, and are fastened to the boss 21*a* by means of a fastener 33. The fastener 33 is shaped with the strap 25 as will be hereinafter described in more detail.

The strap 25 is popular to guitarists, and various sorts of straps are sold in the market. The strap 25 is one of the standard straps. The strap 25 has a flexible belt 25*a* and a pad 25*b*. Holes 25*c* are formed at both end portions of the flexible belt 25*a*. The pad 25*b* is slidable on the flexible belt 25*a* so that the user can adjust the pad 25*b* to his or her shoulder.

Figure 4:
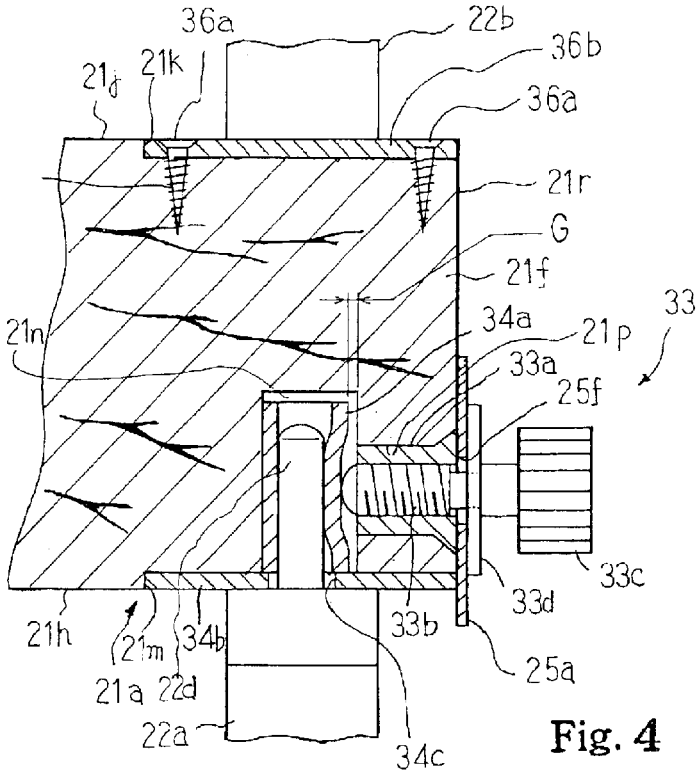
FIG. 4 is a cross sectional view showing a fastener shared between a frame body and a strap.

The frame piece 22*a* is detachably connected to both end portions of the boss 21*a* with the plugs 22*c*/22*d*, and the other frame piece 22*b* is fixed to both end portions of the boss 21*a*. The strap 25 is further connected to the rear/middle end portions of the trunk 21. FIG. 4 shows the rear end portion 21*f* of the boss 21*a*, to which the frame pieces 22*a*/22*b* and flexible belt 25*a* are connected. Since the frame pieces 22*a*/22*b* and flexible belt 25*a* are similarly connected at the other ends to the trunk 21, description is focused on the rear end portion. The side surfaces, which are respectively close to the strings 23*a* and 23*f*, are designated by reference numerals 21*h* and 21*j* in FIG. 4, respectively.

The rear end portion 21*f* is partially narrowed so that steps 21*k* and 21*m* take place between the wide sub-portion and the narrow sub-portion. The side surfaces of the narrow sub-portion are generally rectangular. A recess 21*n* is formed in the narrow sub-portion, and is open to the outside on the side surface. A sleeve 34*a* is loosely received in the recess 21*n* so that gap G takes place between the sleeve 34*a* and the inner surface defining the recess 21*n*. The sleeve 34*a* has an inner diameter larger than the outer diameter of the plug 22*d*. This means that the user can easily insert the plug 22*d* into the sleeve 34*a*. The sleeve 34*a* is made of elastically or resiliently deformable material. The sleeve 34*a* of the elastically or resiliently deformable material is to be recovered to the cylindrical shape after the elastic or resilient deformation equal to the gap G.

A generally rectangular plate 34*b* is attached to the side surface of the narrow sub-portion, and is fixed to the narrow sub-portion by means of wood screws (not shown). The generally rectangular plate 34*b* is made of metal or synthetic resin, and has the thickness approximately equal to the depth of the step 21*m*. For this reason, the outer surface of the plate 34*b* is coplanar with the side surface 21*h*. A through-hole 34*c* is formed in the generally rectangular plate 34*b*, and is aligned with the inner space of the sleeve 34*a*. The through-hole 34*c* has the inner diameter smaller in value than the outer diameter of the sleeve 34*a* so that the generally rectangular plate 34*b* prevents the sleeve 34*a* from dropping out from the recess 21*n*. However, the through-hole 34*c* is larger in diameter than the inner diameter of the sleeve 34*a*. The through-hole 34*c* permits the user to insert the plug 22 into the inner space of the sleeve 34*a*.

The fastener 33 includes a nut 33*a*, a bolt 33*b*, a knob 33*c* and a washer 33*d*. A hole 21*p* is further formed in the rear end portion 21*f*, and is open at one end to the recess 21*h* and at the other end to the outside on the rear end surface 21*r*. The nut 33*a* is inserted into the hole 21*p*, and is fixed to the rear end portion 21*f*. The nut 33*a* is equal in length to the hole 21*p* so that the both end surfaces are coplanar with the inner surface defining the recess 21*n* and the rear end surface 21*r*, respectively. The knob 33*c* is formed with serration, which prevents fingers from slippage. The knob 33*c* is fixed to the bolt 33*b*, and the bolt 33*b* is engaged with the nut 33*a*. The user pinches the knob 33*c* with fingers, and drives the knob 33*c* for rotation. Then, the bolt 33*b* deeply projects through the nut 33*a* into the recess 21*n*. As described hereinbefore, the sleeve 34*a* is elastically or resiliently deformable. When the bolt 33*b* is pressed to the sleeve 34*a*, the sleeve 34*a* is deformed, and is pressed onto the plug 22*d*. Thus, the bolt 33*b* is pressed through the sleeve 34*a* to the plug 22*d*, and prohibits the plug 22*d* from being pulled out.

Holes 25*e* and 25*f* are formed in both end portions of the flexible belt 25*a*. A bolt (not shown) passes through the hole 25*e*, and is engaged with a nut embedded in the trunk. The bolt presses a washer (not shown) to the flexible belt 25*a*, and the washer in turn presses the flexible belt 25*a* to the trunk 21.

Similarly, the bolt 33*b* passes through the hole 25*f*, and the washer 33*d* is pressed to the flexible belt 25*a*. The washer 33*d* presses the flexible belt 25*a* to the rear end surface 21*r*. Thus, the bolt 33*b* not only presses the sleeve 34*a* to the plug 22*d* but also pinches the flexible belt 25*a* between the rear end surface 21*r* and the washer 33*d*. This means that the fastener 33 is shared between the frame piece 22*a* and the flexible belt 25*a*. Only one knob 33*c* is seen around the rear end portion of the trunk 21, and the shared fastener 33 makes the outer appearance of the electric guitar simple.

The frame piece 22*a* is fastened to the front end sub-portion of the boss 21*a* as similar to the fastener 33 at the rear end portion 21*f*. Another fastener 35 is used for the plug 22*c* and the flexible belt 25*a*. The fastener 35 is similar in structure to the fastener 33, and is shared between the frame piece 22*a* and the flexible belt 25*a*. The plug 22*c* is inserted into a elastically or resiliently deformable sleeve embedded in the front end sub-portion of the boss 21*a*, and a nut is further embedded in the front end portion. A bolt with a knob 33*j* is pressed to the sleeve so that the deformed sleeve prevents the plug 22*c* from being dropped out. The knob 33*j* projects from the reverse surface of the trunk 21 as shown, and presses the other end portion of the flexible belt 25*a* to the reverse surface of the trunk 21 through a washer. Thus, the fastener 35 is also shared between the plug 22*c* and the flexible belt 25*a*.

The frame piece 22*b* is fixed to the rear end portion 21*f* by wood screws 36*a*. Generally rectangular plates 36*b* are fixed to both ends of the frame piece 22*b*, and is also made of metal or synthetic resin. Bolt holes are formed in the generally rectangular plate 36*b* at the rear end of the frame piece 22*b*, and the generally rectangular plate 36*b* is attached to the narrow sub-portion. The wood screws 36*a* are screwed through the holes into the rear end portion 21*f*, and presses the generally rectangular plate 36*b* to the side surface of the narrow sub-portion. The generally rectangular plate 36*b* has the thickness equal to the depth of the step 21*k* so that the outer surface of the plate 36*b* is coplanar with the side surface 21*j*. Though not shown in the drawings, a rectangular pit, which is corresponding to the generally rectangular plate at the front end of the frame piece 22*b*, is formed in the front portion of the boss 21*a*, and is open to the outside on the side surface 21*j*. The generally rectangular plate at the front end is snugly received in the rectangular pit, and is fixed to the boss 21*f* by means of the wood screws. Thus, the other frame piece 22*b* is fixed to the side surface 21*j* of the boss 21*a* by means of the wood screws 36*a*.

The trunk 21, to which the frame piece 22*b* has been already fixed, and frame piece 22*a* are assembled in the electric guitar as follows. First, the user inserts the plug 22*d* into the sleeve 34*a* through the hole 34*c* formed in the plate 34*b*. The other plug 22*c* is similarly inserted into the sleeve. The user inserts the bolt 33*b* through the hole 25*f* into the nut 33*a*, and screws the bolt 33*b* into the nut 33*a*. The bolt 33*b* spirally advances through the nut 33*a*, and the tip of the bolt 33*b* is brought into contact with the outer surface of the sleeve 34*a*. The user strongly drives the knob 33*c* for rotation, and presses the tip of the bolt 33*b* to the outer surface of the sleeve 34*a*. The sleeve 34*a* is elastically or resiliently deformed inwardly, and is pressed to the outer surface of the plug 22*d*. The plug 22*d* is further pressed to the inner surface of the sleeve 34*a*. Thus, the plug 22*d* is fastened to the inner surface of the sleeve 34*a*. The other plug 22*c* is also fastened to the inner surface of the sleeve so that the frame piece 22*a* is secured to the boss 21*a*.

As will be understood from the foregoing description, the fasteners 33/35 prevent the frame piece 22*a* from being unintentionally pulled out from the trunk 21. The user inserts the plugs into and pulls out them from the sleeves 34*a*, and turns the knobs 33*c*/33*j* for fastening or loosening the plugs 22*c*/22*d*. The assembling and disassembling works are not complicated. The bolts 33*b* are backward urged by the sleeves 34*a* so that the bolts 33*b* and nuts 33*a* are tightly meshed. Even if the user shakes the electric guitar 20 in the performance, the bolts 33*b* are never chattered.

The plugs 22*c*/22*d* are loosely received in the sleeves 34*a*. This means that the user easily inserts the plugs 22*c*/22*d* into the sleeves 34*a*. Even if the plugs 22*d* are inclined in the sleeves 34*a*, the bolts 33*b* cause the plugs 22*c*/22*d* to press the sleeves 34*a* to the inner surfaces defining the recesses 21*n*, and keep the plugs 22*c*/22*d* vertical.

Moreover, the fastener 33/35 are shared between the frame piece 22*a* and the strap 25. This results in the simple outer appearance of the electric guitar 20.

Second Embodiment

Figure 5:
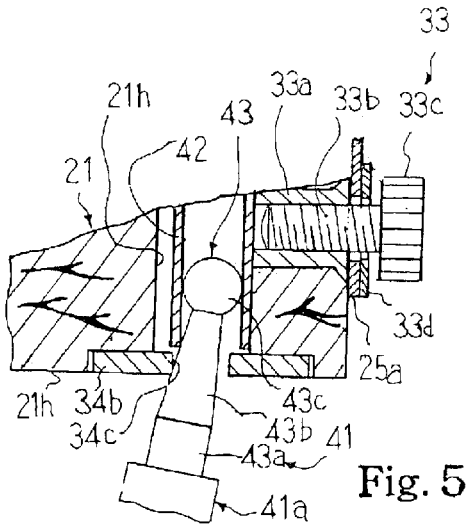
FIGS. 5 and 6 are cross sectional views showing a plug of a frame piece incorporated in another electric stringed instrument according to the present invention.
Figure 6:
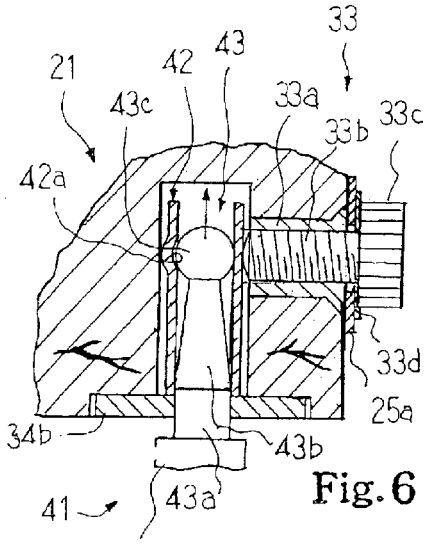

FIGS. 5 and 6 show a frame body 41 incorporated in another electric stringed instrument embodying the present invention. The electric stringed instrument implementing the second embodying the present invention is similar to the electric guitar 20. For this reason, parts of the electric stringed instrument are labeled with the references designating the corresponding parts of the electric guitar 20 without detailed description, and description is focused on the frame body 41.

The frame body 41 is shaped like the contour of a solid body, and plural frame pieces form in combination the frame body 41. One of the frame pieces 41*a* is detachably connected to the trunk 21 by means of fasteners 33, which is shared between the frame piece 41*a* and a strap 25. The other frame piece is similar to the frame piece 22*b*.

The sleeves 34*a* are replaced with sleeves 42, and a dent 42*a* is formed in each of the sleeves 42. The inner surface defining the dent 42*a* is rounded. The plug 22*c*/22*d* are replaced with plugs 43. The plug 43 has a straight boss portion 43*a*, a tapered portion 43*b* and a spherical portion 43*c*. The straight portion 43*a* is approximately equal in diameter to the hole 34*c*, and the spherical portion 43*c* has the radius of curvature equal to that of the dent 42*a*. Thus, a part of the spherical portion 43*c* is fit to the inner surface defining the dent 42*a*. The tapered portion 43*b* is between the straight portion 43*a* and the spherical portion 43*c*, and is decreased in cross section from the straight portion 43*a* toward the spherical portion 43*c*.

When a user assembles the frame piece 41*a* with the trunk 21, the plugs 43 are inserted through the hole 34*c* into the inner surface of the sleeves 42. Even if the user inclines the plugs 43 toward the side surface 21*h*, the tapered portions 43*b* slide the inner edges defining the holes 34*c* (see FIG. 5), and correct the attitude of the plugs 43. As a result, the straight portions 43 are snugly received in the holes 34*c*, and the spherical portions 43*c* reach the dents 42*a* as shown in FIG. 6.

The user engages the bolts 33*b* with the nuts 33*a*, and presses the sleeves 42 to the spherical portions 43*c* and the washers 33*d* and flexible belt 25*a* to the trunk 21.

The advantages of the first embodiment are also achieved by the electric stringed instrument implementing the second embodiment. Moreover, the user easily inserts the plugs 43 into the inner spaces of the sleeves 43 by virtue of the tapered portions 43*b* serving as a guide.

Third Embodiment

Figure 7:
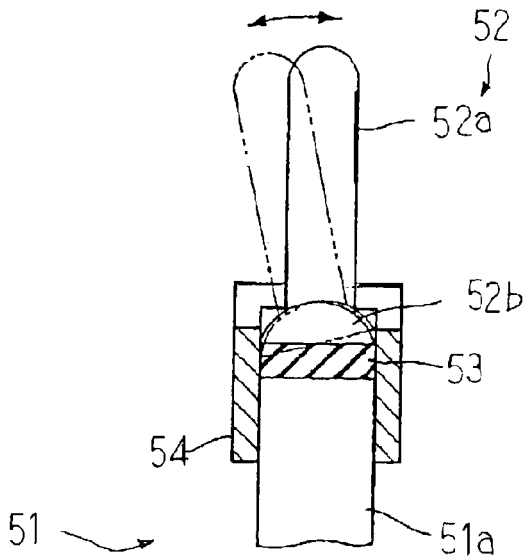
FIG. 7 is a cross sectional view showing a plug of a frame piece incorporated in yet another electric stringed instrument according to the present invention.

Turning to FIG. 7 of the drawings, a frame body 51 is incorporated in yet another electric stringed instrument embodying the present invention. The electric stringed instrument implementing the third embodying the present invention is similar to the electric guitar 20. For this reason, parts of the electric stringed instrument are labeled with the references designating the corresponding parts of the electric guitar 20 without detailed description, and description is focused on the frame body 51.

The frame body 51 is shaped like the contour of a solid body, and plural frame pieces form in combination the frame body 51. One of the frame pieces 51*a* is detachably connected to the trunk by means of fasteners, which is shared between the frame piece 51*a* and a strap 25. The other frame piece is similar to the frame piece 22*b*.

Plugs 52 project from both ends of the frame piece 51*a*, and each plug 52 has a projection 52*a* and a semi-spherical boss 52*b*. The projection 52*a* is integral with the semi-spherical boss 52*b*, and projects therefrom. A resilient block 53 is provided between the frame piece 51*a* and the semi-spherical boss 53 so that the projection 52*a* is inclinable by virtue of the resilient block 53. The plug 52 and resilient block 53 are integrated with the frame piece 51*a* by means of a retainer 54.

The projection 52*a* is inserted into the sleeve 34*a*, which is embedded in the trunk, and the sleeve 34*a* is pressed to the projection 52*a* by means of the fastener 33. The fastener 33 is shared with the strap 25, and all the advantages of the first embodiment are achieved by the electric stringed instrument implementing the third embodiment.

When a user assembles the frame piece 51*a* with the trunk 21, the user inserts the projection 52*a* through the hole 34*c* into the space defined in the sleeve 34*a*. Even if the user inclines the projection 52*a*, the resilient block 53 permits the projection 52*a* to incline as indicated by dots-and-dash line in FIG. 7 so that the user easily inserts the plug 52 into the sleeve 34*a*.

Fourth Embodiment

Figure 8:
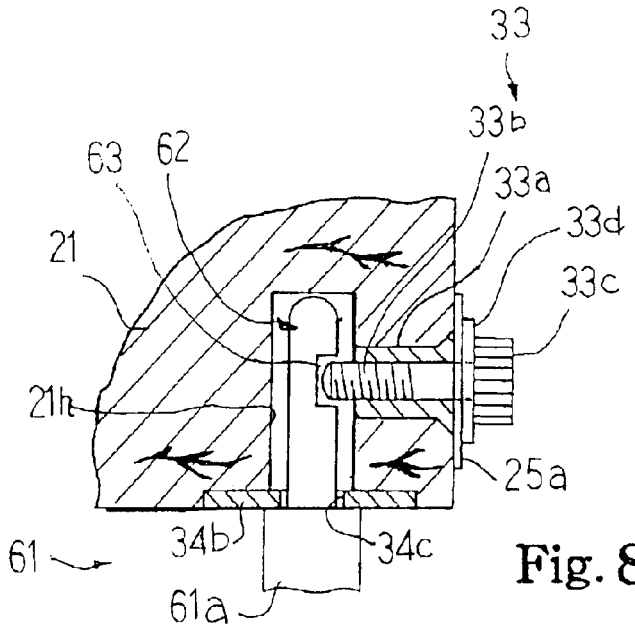
FIG. 8 is a cross sectional view showing a plug of a frame piece incorporated in still another electric stringed instrument according to the present invention.

FIG. 8 shows a frame body 61 is incorporated in still another electric stringed instrument embodying the present invention. The electric stringed instrument implementing the fourth embodying the present invention is similar to the electric guitar 20. For this reason, parts of the electric stringed instrument are labeled with the references designating the corresponding parts of the electric guitar 20 without detailed description, and description is focused on the frame body 61.

The frame body 61 is shaped like the contour of a solid body, and plural frame pieces form in combination the frame body 61. One of the frame pieces 61*a* is detachably connected to the trunk 21 by means of fasteners 33/35, which are shared between the frame piece 61*a* and the strap 25. The other frame piece is similar to the frame piece 22*b*.

Plugs 62 project from both ends of the frame piece 61*a*, and dents 63 are formed in the plugs 62. Any sleeve is not received in the recesses 21*h*. When a user assembles the frame piece 61*a* with the trunk 21, the user inserts the plugs 62 into the recesses 21*h*, and directs the dents to the nuts 33*b*. The user turns the knobs 33*c*, and makes the bolts 33*b* engaged with the nuts 33*a*. The bolts 33*b* projects from the nuts 33*a*, and the tips of the bolts 33*b* reach the dents 63. The tips are pressed to the plugs 62. Thus, the bolts 33*b* prohibit the plugs 62 from being unintentionally pulled out from the recesses 21*h*.

The electric stringed instrument achieves all the advantages of the first embodiment. Any sleeve is not required for the electric stringed instrument. For this reason, the number of parts is decreased, and the production cost is reduced.

Although particular embodiments of the present invention have been shown and described, it will be apparent to those skilled in the art that various changes and modifications may be made without departing from the spirit and scope of the present invention.

The present invention is applicable to any sort of electric stringed instrument in so far as frame bodies are employed. For example, one of the electric stringed instruments is an electric base.

More than one frame pieces may be detachably connected to a trunk. Both of the frame pieces 22*a*/22*b* may be detachably connected to the trunk 21.

Holes may be formed in the plugs 62.

The frame body may have a contour like the outline of an acoustic stringed instrument.

The fasteners shared between the frame body and strap may be available for acoustic stringed instruments.

The pre-amplifier AM and power source BA may be provided outside of the electric stringed musical instrument. Only the pre-amplifier AM may be incorporated in the trunk of an electric stringed instrument.

What is claimed is:

1. A stringed musical instrument slung over a shoulder of a player for playing a piece of music, comprising:

a trunk having plural surfaces;

at least one string stretched over one of said plural surface between both end portions of said trunk;

a frame body having end portions inserted into recesses formed in said trunk and open to the outside on selected ones of said plural surfaces;

a strap making said player sling said stringed musical instrument over said shoulder; and fasteners shared between said frame body and said strap for securing said end portions and both end portions of said strap to said trunk.

2. The stringed musical instrument as set forth in claim 1, in which a converter is provided on said trunk for converting vibrations of said at least one string to an electric signal.

3. The stringed musical instrument as set forth in claim 2, in which a pre-amplifier is further provided inside said trunk, and said converter is connected to said pre-amplifier.

4. The stringed musical instrument as set forth in claim 3, in which a power source is further provided inside said trunk, and supplies electric power to said converter and said pre-amplifier.

5. The stringed musical instrument as set forth in claim 1, in which elastically deformable sleeves are inserted in recesses formed in said trunk so as to receive said end portions, and said fasteners press said both end portions of said strap and said deformable sleeves to selected ones of said plural surfaces and inner surfaces of said trunk defining said recesses, respectively.

6. The stringed musical instrument as set forth in claim 5, in which each of said fasteners includes a first component part formed with a female screw and embedded in said trunk in such a manner as to be partially exposed to associated one of said recesses, a second component part formed with a male screw engaged with said female screw and projecting into said one of said recesses for pressing associated one of said elastically deformable sleeves to said projection and an inner surface defining said associated one of said recesses and a plate formed with a first hole permitting said second component part to pass and pressing one of said end portions of said strap to the associated one of said plural surfaces.

7. The stringed musical instrument as set forth in claim 6, further comprising plate members secured to said trunk for preventing said sleeves from being dropped out from said recesses and formed with respective second holes having an inner diameter larger than the inner diameter of the inner spaces defined in said sleeves and smaller than the outer diameter of said sleeves.

8. The stringed musical instrument as set forth in claim 7, in which said second holes guide said end portions into said sleeves.

9. The stringed musical instrument as set forth in claim 8, in which each of said end portions has a straight portion having a diameter equal to said inner diameter of associated one of said second holes, a spherical portion having a diameter less than said inner diameter of said associated one of said second holes and inserted into said inner space of the associated sleeve and a tapered portion having a cross section decreased from said straight portion to said spherical portion so that said tapered portion guides said straight portion to said associated one of said second holes.

10. The stringed musical instrument as set forth in claim 1, in which said end portions of said frame body are inclinable.

11. The stringed musical instrument as set forth in claim 10, in which each of said end portions has a projection received in a sleeve embedded in said trunk, a resilient block provided between an intermediate portion of said frame body and said projection and a retainer for connecting said projection and said resilient block to said intermediate portion so that said resilient block permits said projection to incline when a force is exerted on said projection.

12. The stringed musical instrument as set forth in claim 11, in which each of said fasteners includes a first component part formed with a female screw and embedded in said trunk in such a manner as to be partially exposed to associated one of said recesses, a second component part formed with a male screw and projecting into said one of said recesses for pressing said sleeve to an inner surface defining associated one of said recesses and said projection and a plate formed with a first hole permitting said second component part to pass and pressing one of said end portions of said strap to the associated one of said plural surfaces.

13. The stringed musical instrument as set forth in claim 1, in which recesses are formed in said trunk so as to receive said end portions, and said fasteners press said both end portions of said strap and said end portions of said frame body to selected ones of said plural surfaces and inner surfaces of said trunk defining said recesses, respectively.

14. The stringed musical instrument as set forth in claim 13, in which each of said fasteners includes a first component part formed with a female screw and embedded in said trunk in such a manner as to be partially exposed to associated one of said recesses, a second component part formed with a male screw engaged with said female screw and projecting into said one of said recesses for pressing one of said end portions to an inner surface defining said associated one of said recesses and a plate formed with a hole permitting said second component part to pass and pressing one of said end portions of said strap to the associated one of said plural surfaces.

15. The stringed musical instrument as set forth in claim 14, in which each of said end portions of said frame body is formed with a dent so that an end portion of said second member is inserted into said dent.

* * * * *